US005454525A

United States Patent [19]

Schamesberger

[11] Patent Number: 5,454,525

[45] Date of Patent: Oct. 3, 1995

[54] PROCESS FOR PRODUCING A READY-TO-USE RACQUET STRING, ESPECIALLY FOR TENNIS RACQUETS

[75] Inventor: Robert Schamesberger, Eisenstadt, Austria

[73] Assignee: ISOSPORT Verbundbauteile Gesellschaft m.b.H., Austria

[21] Appl. No.: 157,083

[22] PCT Filed: Apr. 7, 1993

[86] PCT No.: PCT/AT93/00063

§ 371 Date: Dec. 7, 1993

§ 102(e) Date: Dec. 7, 1993

[87] PCT Pub. No.: WO93/20903

PCT Pub. Date: Oct. 28, 1993

[30] Foreign Application Priority Data

Apr. 9, 1992 [AT] Austria ..... 747/92

[51] Int. Cl.[6] ..... B65H 18/26; B65H 75/28; D02J 1/22

[52] U.S. Cl. ..... 242/147 R; 242/125.1; 242/164; 242/47; 264/290.5; 28/240

[58] Field of Search ..... 28/240; 242/147 R, 242/149, 125.1, 164, 47; 57/310, 320; 264/290.5, 291

[56] References Cited

U.S. PATENT DOCUMENTS

| | | | |
|---|---|---|---|
| 49,861 | 9/1865 | Cumnock | 57/320 |
| 2,142,160 | 1/1939 | Swoyer | 57/320 X |
| 2,338,848 | 1/1944 | Henning et al. | 57/71 |
| 2,559,780 | 7/1951 | Martinson | 242/125.1 |
| 3,750,968 | 8/1973 | Mochizuki et al. | 242/147 R X |
| 4,155,973 | 5/1979 | Klein | 264/291 |
| 4,715,557 | 12/1987 | Rushing et al. | 242/125.1 X |
| 4,835,036 | 5/1989 | Woltron et al. | 428/192 |
| 4,938,432 | 7/1990 | Kurt et al. | 242/125.1 X |

FOREIGN PATENT DOCUMENTS 510390 10/1930 Germany .

*Primary Examiner*—Daniel P. Stodola
*Assistant Examiner*—Michael R. Mansen
*Attorney, Agent, or Firm*—Bacon & Thomas

[57] ABSTRACT

A method for conditioning a racquet string which is tensioned to an elongation between 5 and 15% and in this state is wound on a spool. To implement this process, an untreated string segment is drawn off a supply drum and the end of the untreated string segment is affixed to the periphery of the spool. Thereupon the spool is moved away from the supply drum such that a specified winding length corresponding to the untreated string segment is tensioned to produce a predetermined elongation. While the tension is maintained, the elongated string segment, with simultaneous motion of the spool toward the supply drum, is then wound on the supply spool and lastly the second end of this string segment is affixed to the periphery of the spool.

13 Claims, 3 Drawing Sheets

PROCESS FOR PRODUCING A READY-TO-USE RACQUET STRING, ESPECIALLY FOR TENNIS RACQUETS

BACKGROUND OF THE INVENTION

1. Field of the Invention

The invention concerns a method for making ready-to-use ball game strings in particular for tennis racquets, whereby the string in order to be conditioned for stringing is mounted under tension on a spool where its tension is kept at least essentially constant.

2. Discussion of the Prior Art

A procedure of this kind is known from the document WO-A1-86/02850. The untreated string is taken off under tension from a supply drum braked by a defined torque and is wound at that tension, which generates an elongation in it of 5 to 15% to the length required for stringing, upon the spool.

When the string conditioned by prestressing is taken off the spool to string up in particular a tennis racquet without further delay, the hardness of the stringing drops less in time than if the string had been left unconditioned. Good results are achieved by the procedure described in the document WO-A1-86/02850.

Nevertheless it has been observed that the magnitude of prestressing carried out by the procedure of the said document WO-A1-02850 does vary over the length of the string being wound on the spool. Illustratively when starting the motion of the take-up spool, the tension will increase, and thereby the elongation of the string, over a significant time interval, from an initial zero value to a maximum; thus the tension is not constant during this time interval. Similar considerations apply to the stopping action at the end of spool winding. Moreover tensioned strings undergo creep and the string elongation is further dependent on the rate of winding. Elongation-stabilization would require winding as slowly as possible. However the start-up and stop time intervals with their uneven elongations would be lengthened thereby.

SUMMARY OF THE INVENTION

The object of the invention is to minimize the problems associated with the prior art. The invention solves the problem of creating a method of the initially cited kind in the manner defined in the claims by achieving more uniform prestressing over the entire string length than in the said known procedures.

BRIEF DESCRIPTION OF THE DRAWINGS

The invention is elucidated below in relation to the Figures which are not to scale.

DETAILED DESCRIPTION OF THE PREFERRED EMBODIMENT

Figure 1:
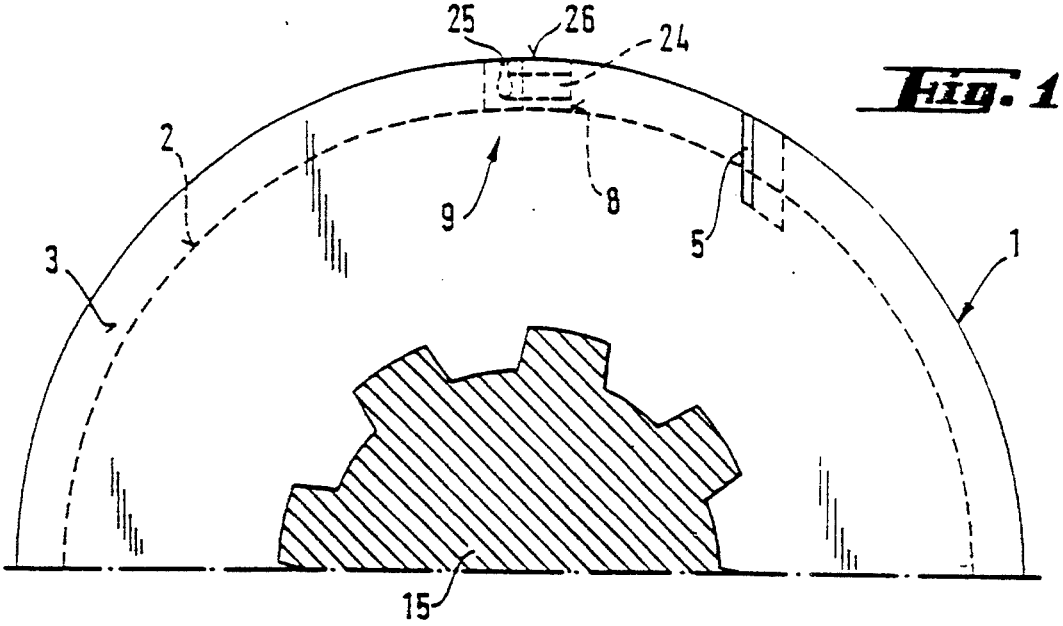
FIG. 1 is a partial elevation of a spool, shown perpendicularly to the spool axis.
Figure 2:
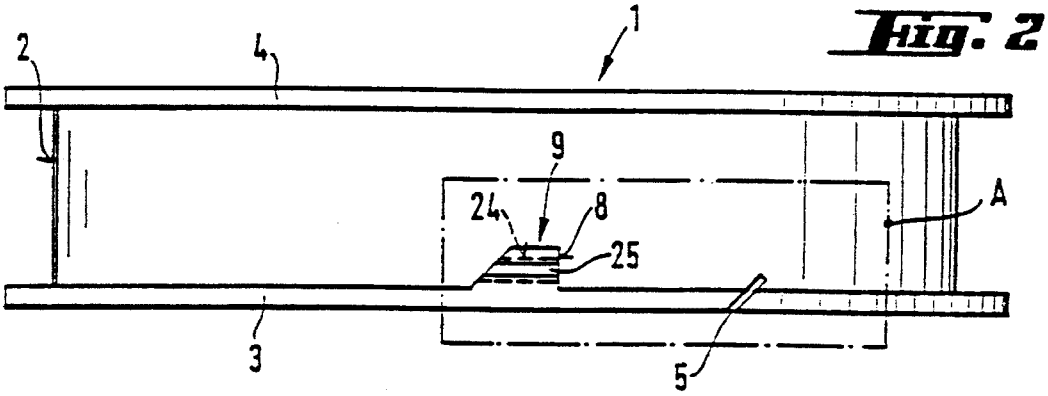
FIG. 2 is a spool section parallel to the spool axis.
Figure 3:
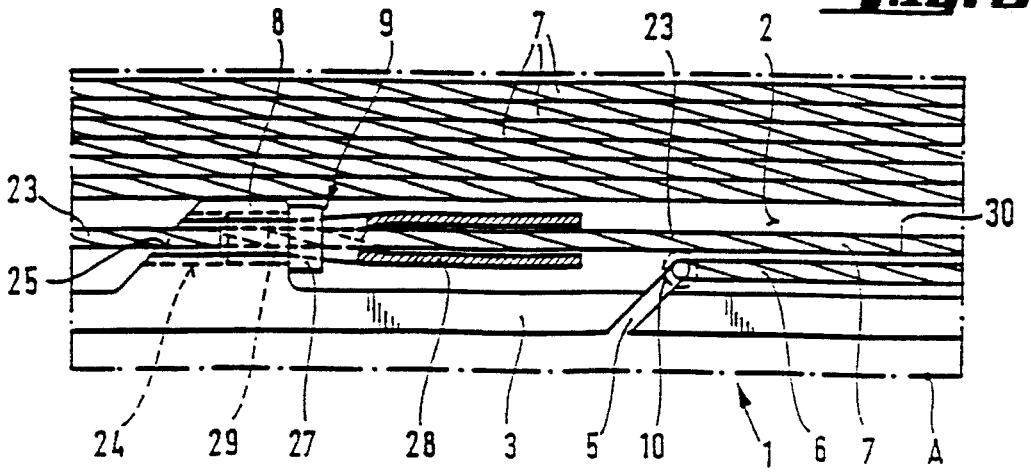
FIG. 3 shows the detail A of the spool of FIG. 2 but in the wound state.

A spool 1 (FIGS. 1 through 3) comprises a convex, circular surface 2 bounded on both sides by spool flanges 3, 4. A slot 5 to affix one of the ends of a string segment 7 to be deposited on the spool 1 is present at the spool flange 3. Also a projection 8 with an arrangement 9 used to affix the second string end is provided and will be comprehensively discussed further below. FIG. 3 furthermore shows the string segment 7 deposited in the form of a winding.

Equipment with which to carry out the method of the invention for simultaneously conditioning two strings will now be illustratively described in relation to FIGS. 4 through 9.

This equipment consists of a frame 11 with a carriage guide 12 for the horizontally displaceable adjustment of a spool carriage 13. A receiving mandrel 15 rotated by a controlled drive 14 (FIG. 9) is mounted on the carriage 13 and may receive two spools 1 simultaneously. An affixing system 16 with a pressure beam 17 and a string guide 18 is mounted next to the right end of the carriage guide 12 shown in the drawings. The equipment also includes two magazines or supply drums 20 for the untreated strings 19.

Figure 4:
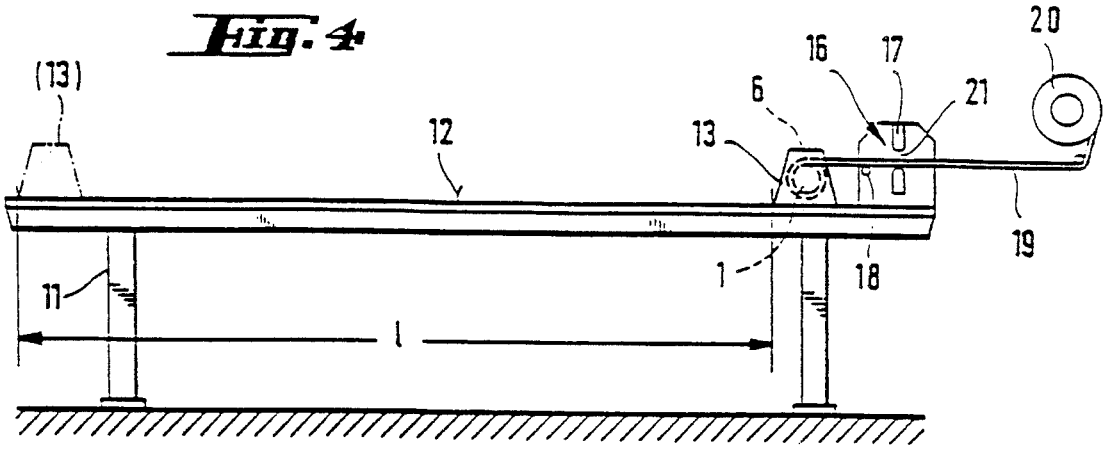
FIGS. 4-8 are schematics of equipment with which to carry out the method of the invention for five different operational stages of the method.
Figure 5:
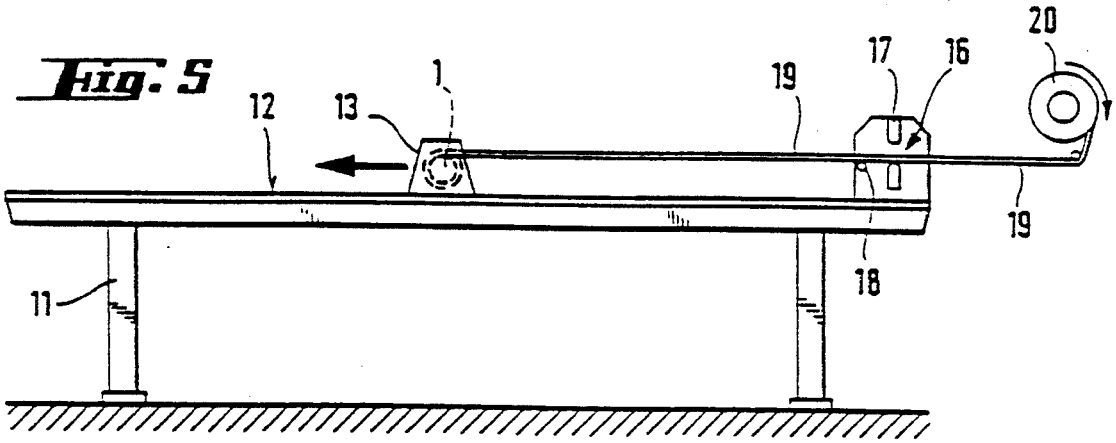

At the beginning of implementing the method of the invention, the carriage 13 assumes its right-hand end position. The equipment operator also is positioned at that end. He first slips two empty spools 1 onto the receiving mandrel 15 which in this position is secured against rotation. Thereupon the ends 6 of the two untreated strings 19 from the supply drums 20 are pulled through the aperture 21 of the affixing system 16 and, each being fitted with an end knot 10, are affixed into the slot 5 of its particular spool 1. This operational stage of the method is shown in FIG. 4.

Next the spool carriage 13 is moved to the left (FIG. 5) as far as its left end position, in the process one untreated string 19 being drawn off each supply drum by a length of 1 to 11 m which is the length of the string segment to be conditioned. Advantageously this motion of the carriage 13 is implemented by a gear rack drive with an omitted drive unit mounted on the carriage 13.

Figure 6:
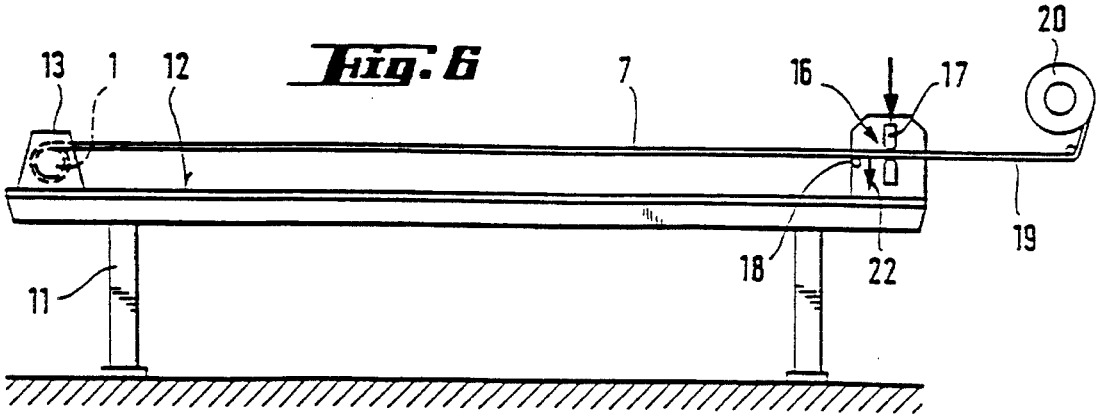

In the next operational stage, the pressure beam 17 of the affixing system 16 is lowered and thereby the drawn off string segment 7 will be held between the spools 1 and the affixing system 16 (FIG. 6). Thereupon a force indicated by the arrow 22 is applied illustratively for 30 seconds between the pressure beam 17 and the string guide 18 separately to each of the two string segments and in such a way as to produce thereupon in the string segments 7 stressed between the spools 1 and the string guide 18 an elongation advantageously from 5 to 15%.

Figure 7:
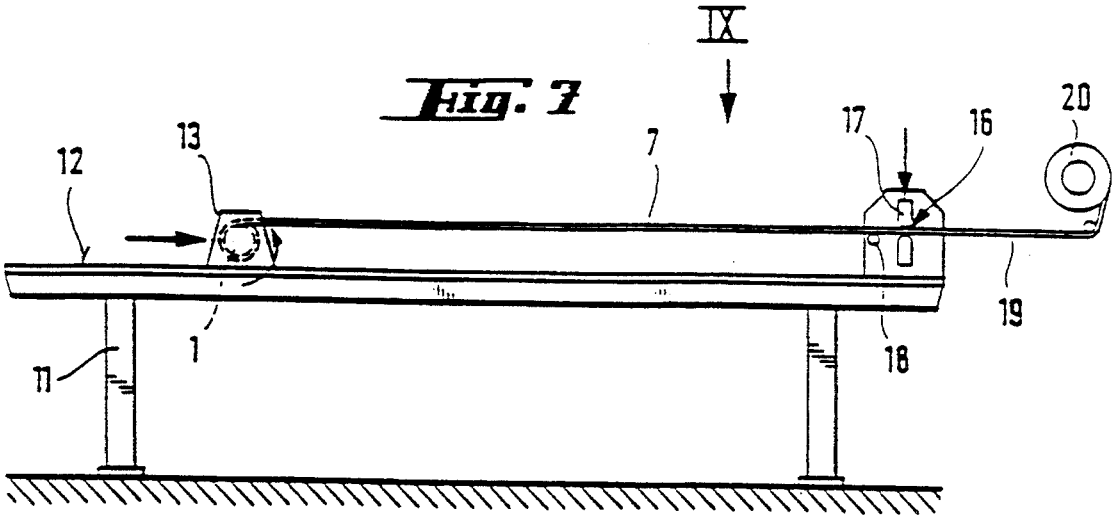
Figure 8:
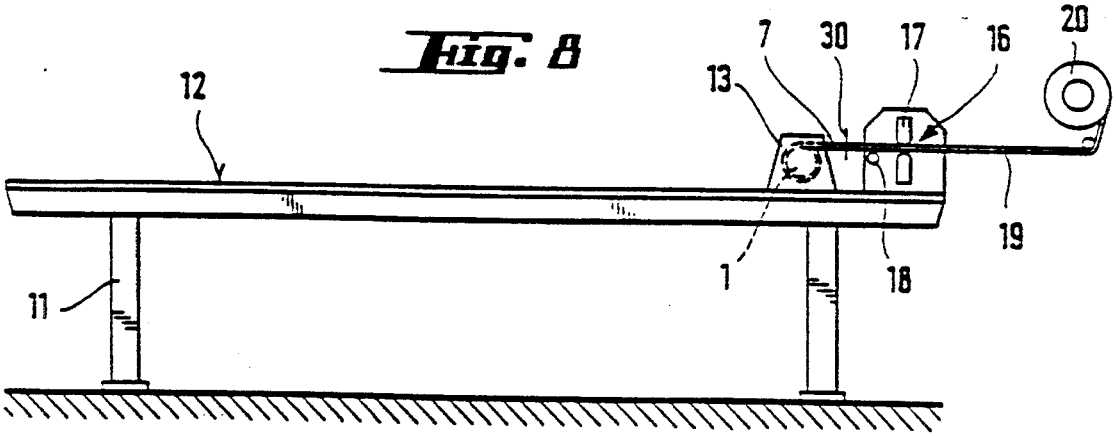
Figure 9:
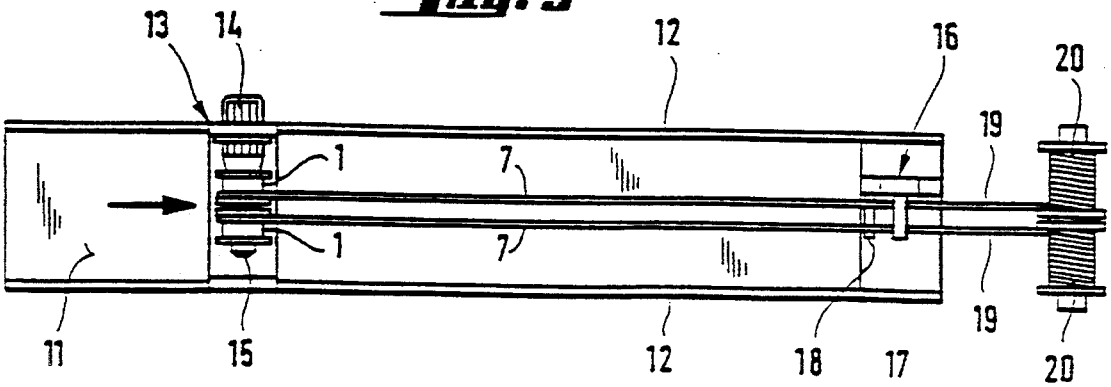
FIG. 9 is a top view of the equipment for simultaneously conditioning two racket strings.

While maintaining the tension in the two string segments 7, the carriage 13 is then displaced as quickly as possible, for instance within 12 seconds, with corresponding rotation of the spools 1 by means of the receiving mandrel 15, i.e., by winding the string segments 7, into its right-hand end position (from the FIG. 7 to the FIG. 8 positions). When winding the strings, the spools are always wound in two layers.

As presently being explained in relation to FIG. 3, the tensioned end 23 of the string will now be affixed, while still under tension, to the spools 1 (FIG. 8). The projection 8 of the affixing arrangement 9 used for this purpose comprises a bore hole 24 communicating through a longitudinal slot 25 with the top side 26 of the projection 8. Affixation takes place by forcing the string 7 through the longitudinal slot 25 into the bore hole 24 of the projection 8. A slotted cylindrical clamping member 27 and a cooperating longitudinally slotted clamping sleeve 28 are deposited in front of the projection 8 onto the string end 23 to be affixed and the clamping sleeve 28 is inserted by its conical end 29 into the cylindrical clamping member 27 which enters the bore hole 24 and which rests on the projection 8, whereby both are being clamped onto the string end 23. Thereafter the force 22 is removed and the string is cut at site 30. Because the string is non-stressed on the other side of affixing system 16, the tensioned string segment 7 on spool 1 pulls the clamping sleeve 28 against the cylindrical clamping member 27, i.e., the projection 8, and thus reinforces affixation.

In a last operational stage, the two fully wound spools 1 are removed from the receiving mandrel 15 and replaced by two empty ones.

One advantage of the method of the invention is that the string is deposited on the spool while its tension remains constant over its length. Moreover only one operator is required who need not change his position at the right-hand end of the carriage 13 and several spools 1 may be simultaneously wound, thereby providing high productivity.

The method of the invention for making ready-to-use ball game strings, in particular tennis racquet strings, achieves more uniform prestressing than in the known methods. This method may be used with various types of string materials, in particular, a string material made from a thermoplastic, such as a thermoplastic containing polyolefin, or a polyolefin. The polyolefin can be predominantly made of polypropylene, preferably a predominately nucleated polypropylene.

I claim:

1. A method for making a ready-to-use racquet string and storing the string at a substantially constant tension on a spool comprising:

drawing a first end of the string from a supply drum;

affixing the first end of said string to a spool;

shifting said spool away from said supply drum such that a string segment of predetermined length is drawn-off said supply drum;

tensioning said string segment to elongate said string segment from 5 to 15%;

winding said string segment onto said spool by rotating said spool and shifting said spool toward said supply drum while maintaining the tension on said string segment; and affixing a second end of said string segment to said spool.

2. The method according to claim 1, wherein the first end of said string is affixed to a peripheral portion of said spool.

3. The method according to claim 1, wherein tensioning said string segment is performed by fixing said supply drum and further shifting said spool away from said supply drum.

4. The method according to claim 1, wherein said string segment is tensioned for more than 20 seconds prior to winding said string segment onto said spool.

5. The method according to claim 1, further comprising retaining tension on the second end of said string segment while the second end is affixed to said spool.

6. The method according to claim 5, wherein the second end of said string segment is affixed to said spool by placing the second end in a slotted clamping sleeve and inserting the clamping sleeve within a bore hole formed in said spool.

7. The method according to claim 1, further comprising utilizing string which is composed, at least predominantly, of a thermoplastic.

8. The method according to claim 7, further comprising incorporating polyolefin in the thermoplastic.

9. The method according to claim 8, further comprising making the polyolefin predominantly of polypropylene.

10. The method according to claim 8, further comprising making the polyolefin of a nucleated polypropylene.

11. The method according to claim 1, wherein said racquet string is a tennis racquet string.

12. A method of making multiple ready-to-use racquet strings and storing each of the strings at a substantially constant tension on a spool comprising:

providing a plurality of supply drums each having a respective non-tensioned racquet string wound thereon;

providing a plurality of spools;

affixing a first end of each string wound on said supply drums to a respective one of said spools;

simultaneously shifting said spools away from said supply drums such that a string segment of predetermined length is drawn-off each of said supply drums;

simultaneously tensioning each of said string segments such that each string segment is elongated from 5 to 15%;

winding each of said string segments onto a respective one of said spools by rotating said spools and shifting said spools toward said supply drums while maintaining the tension on said string segments; and affixing a second end of each of said string segments to a respective one of said spools.

13. The method according to claim 12, wherein said racquet strings are tennis racquet strings.

* * * * *